US007401473B2

(12) United States Patent
Lesage et al.

(10) Patent No.: US 7,401,473 B2
(45) Date of Patent: Jul. 22, 2008

(54) DUAL REFRIGERANT REFRIGERATION SYSTEM AND METHOD

(75) Inventors: Gaétan Lesage, Blainville (CA); Jordan Kantchev, 1925 Guérin, Longueil, QBC (CA) J4N 1J3

(73) Assignees: Systems LMP Inc., Laval, Quebec (CA); Jordan Kantchev, Longueuil, Quebec (CA)

( * ) Notice: Subject to any disclaimer, the term of this patent is extended or adjusted under 35 U.S.C. 154(b) by 323 days.

(21) Appl. No.: 11/234,086

(22) Filed: Sep. 26, 2005

(65) Prior Publication Data

US 2007/0068187 A1 Mar. 29, 2007

(51) Int. Cl.
*F25D 17/02* (2006.01)

(52) U.S. Cl. ..... 62/277; 62/59; 62/330; 62/434

(58) Field of Classification Search ..... 62/59, 62/277–278, 246–256, 330, DIG. 2, 430–439
See application file for complete search history.

(56) References Cited

U.S. PATENT DOCUMENTS 3,216,215 A * 11/1965 Schuett ..... 62/185
4,009,594 A 3/1977 Swanson
4,044,568 A * 8/1977 Hagen ..... 62/73
4,102,151 A 7/1978 Kramer et al.
4,279,129 A 7/1981 Cann et al.
4,280,335 A * 7/1981 Perez et al. ..... 62/332
4,318,277 A 3/1982 Cann et al.
4,602,485 A 7/1986 Fujimoto et al.
4,688,392 A 8/1987 Fujimoto et al.
4,838,039 A * 6/1989 Knodel ..... 62/330
4,914,926 A 4/1990 Gregory
4,949,551 A 8/1990 Gregory
5,005,364 A * 4/1991 Nelson ..... 62/76
5,050,400 A 9/1991 Lammert
5,056,327 A 10/1991 Lammert
5,065,320 A * 11/1991 Hayashi et al. ..... 701/1
5,065,584 A 11/1991 Byczynski et al.
5,065,598 A * 11/1991 Kurisu et al. ..... 62/330
5,315,836 A 5/1994 Ressler
5,335,508 A * 8/1994 Tippmann ..... 62/129
5,381,670 A * 1/1995 Tippmann et al. ..... 62/330
5,551,250 A 9/1996 Yingst et al.
5,575,158 A 11/1996 Vogel
5,867,993 A 2/1999 Dube
5,887,440 A 3/1999 Dube
6,012,298 A * 1/2000 Goldstein ..... 62/185
6,089,033 A 7/2000 Dube (Continued)

*Primary Examiner*—William E Tapolcai
(74) *Attorney, Agent, or Firm*—Equinox Protection; Franz Bonsang, Patent Agent

(57) ABSTRACT

A dual refrigerant refrigerating system provides a refrigeration cycle in which a primary refrigerant cools a secondary refrigerant in a primary evaporator into a partially frozen state, in which a fusion portion thereof is frozen. The primary refrigerant thus absorbs a secondary latent heat from secondary refrigerant, including a latent heat of fusion required for freezing the fusion portion. Secondary refrigerant is subsequently at least partially thawed, in a secondary evaporator, by re-absorption thereby of secondary latent heat from material proximal to secondary evaporator. Evaporation in secondary evaporator requires at least partial thawing of fusion portion, and thus latent heat of fusion is at least partially re-absorbed by secondary refrigerant, thus increasing secondary heat absorbed from material and facilitating refrigeration thereof. The system also provides defrost and heat reclaim capabilities.

22 Claims, 1 Drawing Sheet

U.S. PATENT DOCUMENTS 6,158,499 A * 12/2000 Rhodes et al. ..... 165/10
6,185,944 B1 * 2/2001 Gaul ..... 62/115
6,286,322 B1 9/2001 Vogel et al.
6,332,335 B1 * 12/2001 Kajimoto et al. ..... 62/434
6,540,605 B1 4/2003 Lesage
6,775,993 B2 8/2004 Dube
6,807,813 B1 10/2004 Lesage

* cited by examiner

DUAL REFRIGERANT REFRIGERATION SYSTEM AND METHOD

FIELD OF THE INVENTION

The present invention concerns refrigeration systems and methods, more particularly refrigeration systems and methods employing dual refrigerants.

BACKGROUND OF THE INVENTION

Refrigeration systems are commonly used in supermarkets to refrigerate or to maintain in frozen state perishable products, such as foodstuff.

Conventionally, refrigeration systems include a network of refrigeration compressors and evaporators. Refrigeration compressors mechanically compress refrigerant vapor, which is circulated from the evaporators, to increase its temperature and pressure. The resulting high-temperature refrigerant vapor, under high-pressure, is circulated to a refrigerant condenser where the latent heat from the vapor is absorbed. As a result, the refrigerant vapor liquefies into refrigerant liquid. The refrigerant liquid is circulated through refrigerant expansion valves, thereby reducing the temperature and pressure, to the evaporators wherein the refrigerant liquid evaporates by absorbing heat from the surrounding foodstuff.

Refrigeration systems as described above which use a single refrigerant typically require a significant amount of such refrigerant. Thus, should leaks occur in such a system, there is a risk of substantial amounts of refrigerant being leaked into the environment or into foodstuffs. Since leaked refrigerant may be damaging to the environment and to foodstuffs, such a situation is highly undesirable.

Use of dual refrigerant systems, i.e. having a primary and a secondary refrigerant, may, to a certain extent attenuate this problem, as only a secondary refrigerant, cooled by a primary refrigerant, is circulated in secondary evaporators near the foodstuffs. Thus, even if a leak develops in these secondary evaporators, only secondary refrigerant will be affected. However, since it is secondary refrigerant which actually cools the foodstuffs, this is only a partial solution since leaks of secondary refrigerant will eventually lead to deterioration of refrigeration capacity of the system, as well as possibly to damage of the foodstuffs. Further, such dual refrigerant systems often require circulation, i.e. flow, of large amounts of secondary refrigerant through the evaporators for cooling foodstuffs at any given moment. Obviously, use of large amounts of secondary refrigerant continues to leave the system vulnerable to leaks and is also costly due to the amount of secondary refrigerant that must be supplied.

Accordingly, it would be useful to have a dual refrigerant system in which flow of secondary refrigerant flow is reduced for increasing efficiency and decreasing vulnerability to leaks.

SUMMARY OF THE INVENTION

The present invention provides a dual refrigerant refrigeration system for providing refrigeration during a refrigeration cycle.

It is an advantage of the present invention that refrigeration is provided with reduced flow and quantity of secondary refrigerant.

It is a further advantage of the invention that the system is less prone to cause pollution of material, such as foodstuffs, refrigerated thereby or of the environment due to leaks.

In one aspect, the present invention provides a dual refrigerant refrigeration system comprising:

at least one compressor for compressing a primary refrigerant, as a primary refrigerant vapor, the compressor being engageable in a refrigeration cycle;

a refrigerant condenser operatively connected to the at least one compressor for condensing, after the compressing, the primary refrigerant vapor into a primary refrigerant liquid;

a spray primary evaporator operatively connected to the at least one compressor and having at least one secondary refrigerant tube through which a secondary refrigerant circulates in the primary evaporator and at least one perforated tube operatively connected to the refrigerant condenser and through which the Primary refrigerant liquid flows, the primary refrigerant liquid being sprayed through perforations in the at least one perforated tube onto the at least one secondary refrigerant tube and absorbing therefrom a secondary latent heat of the secondary refrigerant and cooling the secondary refrigerant therein to a partially frozen state in which a fusion portion thereof is frozen, the secondary latent heat comprising a latent heat of fusion absorbed during freezing of the fusion portion, the primary refrigerant liquid refrigerant being evaporated into the primary refrigerant vapor by absorbing the secondary latent heat; and at least one secondary evaporator operatively connected to the primary evaporator and engageable in the refrigeration cycle for receiving the partially frozen secondary refrigerant for at least partial thawing of the partially frozen secondary refrigerant including the fusion portion thereof, into a partially thawed state by at least partial re-absorption of the secondary latent heat, and thereby of the latent heat of fusion, from material refrigerated by the secondary evaporator, the fusion portion Increasing the secondary latent heat re-absorbed from the material by the secondary refrigerant during the refrigeration cycle.

In another aspect, the present invention provides a method for providing refrigeration of material with a compressor operatively connected to a primary evaporator operatively connected to a secondary evaporator and to a refrigerant condenser. The method comprises the steps of:

a) compressing a primary refrigerant received by the compressor, as primary refrigerant vapor, from the primary evaporator;

b) after the compressing, condensing the primary refrigerant in the refrigerant condenser from the primary refrigerant vapor into the primary refrigerant liquid;

c) after the condensing, evaporating the primary refrigerant liquid by absorption of secondary latent heat thereby, including a heat of fusion, from the secondary refrigerant in the primary evaporator, thereby cooling the secondary refrigerant into a partially frozen state in which a fusion portion thereof is frozen by absorption of the heat of fusion; and d) after the evaporating of the primary refrigerant, at least partially thawing the secondary refrigerant, including the fusion portion, in the partially frozen state in the second evaporator by re-absorption therein of the secondary latent heat, including the secondary latent heat, from the material for thereby refrigerating the material.

BRIEF DESCRIPTION OF THE FIGURE

Further aspects and advantages of the present invention will become better understood with reference to the description, provided for purposes of illustration only, in association with the following figure, wherein.

DETAILED DESCRIPTION OF THE PREFERRED EMBODIMENT

Figure 1:
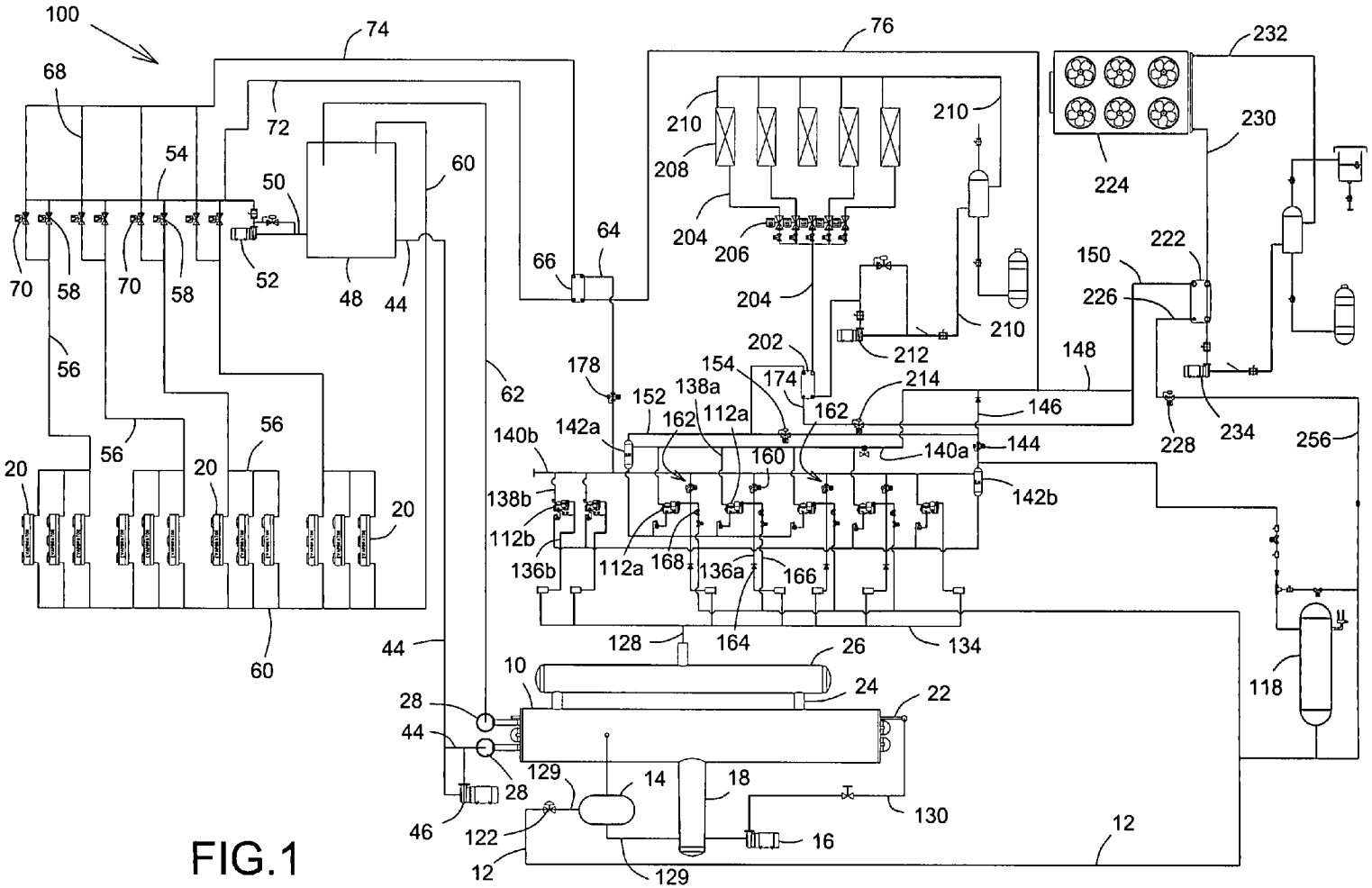
FIG. 1 is a schematic diagram of a dual refrigerant refrigeration system having a primary evaporator and a secondary evaporator, in accordance with a first embodiment of the present invention.

Reference is now made to FIG. 1, a schematic diagram of a dual refrigerant heat reclaim refrigeration system, shown generally as 100, having a primary evaporator and a secondary evaporator, in accordance with an embodiment of the present invention. Broadly speaking, system 100 includes compressors. 112, an indoor glycol-cooled condenser 222 as a refrigerant condenser, a primary evaporator 10 for evaporating a primary refrigerant compressed by compressors 112 and received from a primary refrigerant receiver 118, a plurality of secondary refrigerant evaporators 20 for refrigerating material in proximity thereto during refrigeration cycles using a secondary refrigerant cooled in the primary evaporator 10, a primary refrigerant expansion valve 122, and a heat reclaim means for reclaiming primary latent heat in the primary refrigerant generated and rejected by system 100. The aforementioned elements are operatively connected in system 100 by a plurality of lines, passageways, manifolds, and conduits, through which primary and secondary refrigerants, glycol, and water are circulated in the system 100 with the aid of pumps 16, 46, 52, 212, 234. System 100 is capable of generating variable levels of pressure for the primary refrigerant, used for cooling the secondary refrigerant, and the primary refrigerant may vary between states as a primary refrigerant liquid and a primary refrigerant vapor. Secondary refrigerant varies between a slush-like partially frozen state, for refrigerating material, such as foodstuffs or the like, in proximity to secondary evaporators 20 by absorbing heat therefrom, and a warmed, at least partially thawed state after being at least being partially thawed in secondary evaporator by absorbing heat from the material. Secondary refrigerant may also be heated into a heated defrost state for defrosting a frosted secondary evaporator 20 during a defrost cycle.

In the embodiment, compressors 112 include a first compressor 112*a* that is engageable in the heat reclaim cycle, when required, and the refrigeration cycle, and a second compressor 112*b* that is engageable in the refrigeration cycle. Secondary evaporator 20 is engageable in the refrigeration cycle and a defrost cycle in which secondary evaporator 20 is defrosted using hot primary refrigerant vapor provided by second compressor 112*b*. Thus, system 100 can execute refrigeration cycles simultaneously with defrost cycles and heat reclaim cycles. It should be noted that, while the present invention may implemented with only one compressor 112, such an implementation will not permit simultaneous execution of refrigeration cycles with defrost cycles and heat reclaim cycles. The connections between the elements of the invention and the role thereof in each of the refrigeration, heat reclaim, and defrost cycles will now be described in detail.

With regard to compressors 112, when engaged in the refrigeration cycle, compressor 112 compresses primary refrigerant as low-pressure primary refrigerant vapor, which is received thereby from primary evaporator 10. Primary evaporator 10 is connected to primary evaporator refrigerant vapor line 128 and primary evaporator refrigerant liquid line 130, through which primary refrigerant flows, respectively, as primary refrigerant vapor, and primary refrigerant liquid. Primary evaporator refrigerant vapor line 128 circulates the low-pressure refrigerant vapors into suction manifold 134. Each compressor 112 has at least one suction inlet line 136, connected to suction manifold 134, and at least one discharge outlet line 138. Specifically, suction inlet line 136*a* of compressor 112*a* connects compressor 112*a* to the suction manifold 134, whereas suction inlet line 136*b* of compressor 112*b* connects compressor 112*b* to suction manifold 134. Thus, compressor 112 is operatively connected to primary evaporator through suction manifold 134 and suction inlet line 136, and primary evaporator refrigerant vapor line 128.

Suction inlet line 136 receives the low-pressure primary refrigerant vapor from suction manifold 134 and compressor 112 compresses the low-pressure primary refrigerant vapor, thereby increasing its pressure and temperature, to produce high-temperature, high-pressure primary refrigerant vapor. Once the primary refrigerant vapor is so compressed, it is circulated from the compressor 112 through discharge outlet line 138 to discharge outlet manifolds 140, and then to oil separators 142, which reduce the amount of any oil from compressor 112 that may have become mixed with the primary refrigerant vapor during compression in the compressor 112. Specifically, compressor 112*a* discharges the primary refrigerant vapor through first discharge outlet line 138*a* into first discharge outlet manifold 140*a*, and then through first oil separator 142*a*. Compressor 112*b* discharges primary refrigerant vapor through second discharge outlet line 138*b* into second discharge outlet manifold 140*b*, and then through second oil separator 142*b*.

In colder environments, i.e. those having sub 32 degree Fahrenheit (+32° F.) temperatures similar to those found in the northern part of the United States or Canada during colder periods of the year, pressure and temperature of primary refrigerant vapor discharged from compressors 112 engaged in refrigeration cycle, while still high compared to entry of primary refrigerant vapor into compressors 112, can be reduced, due to colder ambient air temperature for outdoor air-cooled glycol cooler 224, situated outdoors, compared to warmer environments. The colder ambient air temperature in such colder environments allows glycol, heated into heated glycol after condensing primary refrigerant vapor into primary refrigerant liquid in glycol-cooled condenser 222, to be more readily and quickly cooled, and to cooler temperatures, than in warmer environments. Thus, heated glycol is cooled into cooled glycol more quickly or to a greater extent allowing greater and more efficient cooling of primary refrigerant during condensing thereof in indoor glycol-cooled condenser 222.

Therefore, indoor glycol-cooled condenser 222 can function with a lower condensing pressure, i.e. the pressure required from compressors 112 to cause the primary refrigerant to condense into primary refrigerant liquid for use in the refrigeration cycle, to take advantage of the lower ambient air temperature in the colder environment. Accordingly, less compressing is required of compressors 112, thereby reducing energy requirements thereof. In other words, while primary refrigerant vapor is still compressed to high-temperature and high-pressure in colder environments, the temperature and pressure thereof can nonetheless be reduced compared to those required in warmer environments. For example, firstly, where there are multiple compressors 112, each compressor 112 could be set, for colder environments, to compress primary refrigerant vapor to a lower pressure than would be the case in a warmer environment. Secondly, a number of compressors 112 could be deactivated and all of the compression for refrigeration undertaken by a reduced number of compressors. Thirdly, and as specifically explained below for the embodiment, compression in colder environments for refrigeration cycles could be undertaken at substantially the same levels as for warmer environments and the additional/unused energy, i.e. primary latent heat in primary refrigerant, generated by such compression could be reclaimed in a heat reclaim cycle. A combination of these three options could also be envisaged.

During the refrigeration cycle, once the high-pressure primary refrigerant vapor has passed through oil separator 142, it circulates to refrigerant condenser, i.e. indoor glycol-cooled condenser 222 connected to outdoor air-cooled glycol cooler 224. Specifically, for compressor 112*b*, the high-pressure primary refrigerant vapor circulates through primary refrigerant pressure-regulating valve 144 in refrigerant condenser inlet line 146 and then through refrigerant condenser inlet lines 148 and 150, respectively, to indoor glycol-cooled condenser 222. For compressor 112*a*, the high-pressure primary refrigerant vapor passes through conduit 152 to double set point pressure-regulating valve 154 and then through refrigerant condenser inlet lines 146, 148, and 150, respectively, to indoor glycol-cooled condenser 222. Thus, discharge outlet line 138, and therefor compressor 112, are operatively connected to refrigerant condenser, i.e. in the embodiment, indoor glycol-cooled condenser 222 connected to outdoor air-cooled glycol cooler 224. Double set point pressure-regulating valve 154 is set, during refrigeration cycles, to regulate pressure in conduit 152, first discharge outlet manifold 140*a*, and first discharge outlet line 138*a* to substantially the same pressure level as in second discharge outlet manifold 140*b* and second discharge outlet line 138*b*. Thus, the pressure level of primary refrigerant circulated from all compressors 112 engaged in the refrigeration cycle to indoor glycol-cooled condenser 222 is substantially the same.

During a refrigeration cycle, primary refrigerant received by refrigerant condenser, i.e. indoor glycol-cooled condenser 222 connected to outdoor air-cooled glycol cooler 224, is typically in the form of primary refrigerant vapor. However, primary refrigerant that has passed through heat reclaim means during heat reclaim cycle may be in the form of primary refrigerant liquid. In glycol-cooled condenser 222, primary refrigerant is condensed into high-pressure primary refrigerant liquid as cooled glycol therein absorbs primary latent heat of the primary refrigerant. The cooled glycol is thus heated into heated glycol. After condensing, the high-pressure primary refrigerant is circulated through glycol-cooled refrigerant outlet line 226. Refrigerant pressure-regulating valve 228 disposed upon glycol-cooled refrigerant outlet line 226 maintains the desired minimum condensing pressure of primary refrigerant liquid in indoor glycol-cooled condenser 222. After passing through refrigerant pressure-regulating valve 228, primary refrigerant liquid circulates through refrigerant condenser outlet line 256 to primary refrigerant liquid surge receiver 118.

Glycol circulates to and from indoor glycol-cooled condenser 222 in a closed-loop system. Specifically, heated glycol circulates from glycol-cooled condenser 222 into outdoor air-cooled glycol cooler 224 via glycol inlet line 230. Heated glycol then passes through the outdoor air-cooled glycol cooler 224 where cool air absorbs heat from the heated glycol, thus cooling the heated glycol into cooled glycol. The cooled glycol then circulates through glycol outlet line 232 to glycol pump 234 disposed along glycol outlet line 232. Glycol pump 234 pumps cooled glycol back to indoor glycol-cooled condenser 222 to be used again for condensing the primary refrigerant.

From primary refrigerant liquid surge receiver 118, primary refrigerant liquid circulates through primary refrigerant liquid transport line 12 to expansion valve 122, which expands the primary refrigerant liquid. Expanded primary refrigerant then passes through primary refrigerant reservoir line 129 to liquid level sensor chamber 14 and then to primary refrigerant reservoir 18. Liquid level sensor chamber 14 has a liquid level sensor, not shown, disposed therein which detects the level of expanded primary refrigerant liquid in primary refrigerant reservoir 18. Should the level of expanded primary refrigerant liquid in primary refrigerant reservoir fall below a minimal threshold level required for primary evaporator 10, additional expanded refrigerant liquid will be fed from expansion valve 122 through primary refrigerant reservoir line 129 to primary refrigerant reservoir 18 until the minimal threshold level is reached. From primary refrigerant reservoir 18, expanded primary refrigerant liquid is pumped through primary evaporator refrigerant liquid line 130, by re-circulating pump 16 disposed thereupon, to perforated tube 22 of primary evaporator 10. Thus primary evaporator is operatively connected to indoor glycol-cooled condenser 222 and liquid surge receiver 118 by glycol-cooled refrigerant outlet line 226, refrigerant condenser outlet line 256, primary refrigerant liquid transport line 12, primary refrigerant reservoir line 129, and primary evaporator liquid refrigerant line 130 to primary evaporator 10.

After being pumped, and circulated thereby, by re-circulating pump 16 to perforated tube 22 of primary evaporator 10, primary refrigerant liquid circulates in perforated tube 22 in primary evaporator 10 and is spayed through perforations in perforated tube 22 upon at least one secondary refrigerant tube 28 within which secondary refrigerant circulates within primary evaporator 10. When primary refrigerant liquid is sprayed upon secondary refrigerant tube 28, primary refrigerant liquid absorbs a latent secondary heat from the secondary refrigerant circulating therein, thus causing primary refrigerant liquid to evaporate, at least partially, into primary refrigerant vapor. The primary refrigerant vapor rises in primary evaporator 10 through primary refrigerant vapor tubes 24 to primary refrigerant surge drum 26 connected to primary evaporator refrigerant vapor line 128. In primary refrigerant surge drum 26, primary refrigerant vapor is separated from primary refrigerant liquid and primary refrigerant vapor. Primary refrigerant vapor then circulates through primary evaporator refrigerant vapor line 128 to compressors 12 for re-use. Primary refrigerant liquid separated in surge drum 26, as well as any primary refrigerant liquid that exits through perforations in perforated tube 22 and is not evaporated, drains through primary evaporator 10 back into primary refrigerant reservoir 18 and is re-circulated therefrom through primary evaporator refrigerant liquid line 130 by re-circulating pump 16 perforated tube 22 for subsequent evaporation in primary refrigerant liquid line. Thus, any unevaporated portion of primary refrigerant liquid that circulates through primary evaporator 10 without being evaporated is re-circulated thereto by primary refrigerant re-circulating pump 16 until the unevaporated portion is eventually evaporated into primary refrigerant liquid.

As the latent secondary heat is absorbed from secondary refrigerant by the primary refrigerant in primary evaporator 10, the secondary refrigerant circulating in secondary refrigerant tube 28 is cooled to a slush-like partially frozen state in which a fusion portion of the secondary refrigerant circulating in secondary refrigerant tube 28 is frozen. The result is that secondary refrigerant circulating and cooled in primary evaporator 10 into partially frozen state resembles slush, which, while partially frozen, can still be circulated to secondary evaporator 20 for refrigerating material, such as foodstuffs, in proximity to secondary evaporator 20. Freezing of the fusion portion of the secondary refrigerant requires a change of state thereof in which the fusion portion changes from a liquid to a solid. As changes from liquid state to solid state for a given substance involves removal of a substance's heat of fusion therefrom, a latent heat of fusion is absorbed by primary refrigerant, as part of secondary latent heat, from fusion portion of secondary refrigerant during cooling thereof, corresponding to evaporation of primary refrigerant, in primary evaporator 10. After cooling in primary evaporator, secondary refrigerant, in partially frozen state, is circulated to secondary evaporators 20, secondary refrigerant tank 48, and, as required defrost heat exchanger 66, which are operatively connected to each other, and to primary evaporator 10, by secondary refrigerant lines 44, 50, 54, 56, 60, 62, 68, 72, 74.

Once secondary refrigerant is rendered into partially frozen state in primary evaporator 10, secondary refrigerant exits primary evaporator through supply secondary refrigerant line 44, which is connected to secondary refrigerant tube 28. Secondary refrigerant pump 46, disposed upon supply secondary refrigerant line 44, pumps the secondary refrigerant to secondary refrigerant tank 48, in which a quantity of secondary refrigerant in partially frozen state is stored. From secondary refrigerant tank 48, secondary refrigerant in partially frozen state is circulated through tank secondary refrigerant line 50, connected to tank 48, to tank secondary refrigerant pump 52, also connected to tank secondary refrigerant line 50. Secondary refrigerant in partially frozen state then circulates, pumped by tank secondary refrigerant pump 52, through feeder secondary refrigerant line 54 connected to tank secondary refrigerant pump 52, to at least one input secondary refrigerant line 56.

Each secondary evaporator 20 is operatively connected to at least one input secondary refrigerant line 56, through which a supply of secondary refrigerant in partially frozen state is circulated when secondary evaporator 20 connected thereto is engaged in the refrigeration cycle. Circulation of supply of the secondary refrigerant in partially frozen state through input secondary refrigerant line 56 to secondary evaporator 20 connected thereto is modulated by modulating valve 58 disposed on input secondary refrigerant line 56. Modulating valve is at least partially open when secondary evaporator 20 connected to input secondary refrigerant line 56 is engaged in refrigeration cycle to allow secondary refrigerant in partially frozen state to circulate therethrough to secondary evaporator 20 connected thereto.

During the refrigeration cycle, when secondary refrigerant in partially frozen state enters secondary evaporator 20, it is at least partially thawed by re-absorption thereby of secondary latent heat from material to be refrigerated situated in proximity to secondary evaporator 20. Thus, the material is cooled and refrigerated. As the secondary refrigerant is at least partially thawed, at least part of fusion portion is changed, i.e. thawed, from solid to liquid state.

The latent heat of fusion of fusion portion is therefore at least partially re-absorbed, as part of the secondary latent heat, by secondary refrigerant during thawing in secondary evaporator 20 during refrigeration cycle. Accordingly, the amount of secondary latent heat re-absorbed from the material by secondary refrigerant is augmented due the latent heat of fusion reabsorbed by the fusion portion of secondary refrigerant when compared to use of secondary refrigerant without a partially frozen fusion portion. In other words, partially frozen secondary refrigerant having partially frozen fusion portion absorbs more secondary latent heat from material in proximity to secondary evaporator 20 than would be the case without frozen fusion portion. The amount of secondary refrigerant required for circulation, or flow of secondary refrigerant, in secondary evaporator 20 to provide a given level of refrigeration to material in proximity to secondary evaporator 20 is therefor reduced with respect to use of secondary refrigerant without fusion portion. Efficiency of secondary refrigerant is thereby improved and the amount of secondary refrigerant required is reduced.

Advantageously, since there is lower quantity of secondary refrigerant flowing through the system 100 when secondary refrigerant is in partially frozen state, the amount thereof that may be lost over any given period of time should a leak or hole develop in any of the lines/conduits carrying secondary refrigerant in system 100 is reduced. This reduces risk of pollution of the environment and of foodstuffs in the event of a leak. Further, the reduction in quantity of secondary refrigerant also reduces cost of system 100. Once secondary refrigerant has been circulated through secondary evaporator 20 engaged in refrigeration cycle, it is circulated through output secondary refrigerant line 60 back to secondary refrigerant tank 48. From secondary refrigerant tank 48, secondary refrigerant circulates through return secondary refrigerant line 62, connected to secondary refrigerant tube 28, to primary evaporator 10, where it is again cooled for subsequent use.

Turning now to the defrost cycle, through repeated refrigeration cycles, an increasing amount of frost will build up in secondary evaporator 20, reducing the efficiency thereof for refrigeration cycles. When a predetermined quantity of frost builds up in secondary evaporator 20, secondary evaporator becomes a frosted secondary evaporator 20 and frosted secondary evaporator 20 engages in defrost cycle. During defrost cycle, defrost solenoid valve 178, otherwise closed, opens to allow primary refrigerant vapor compressed to high temperature by compressor 112*b*, engaged in refrigeration cycle, to circulate from second discharge outlet manifold 140*b* through primary defrost outlet line 64 to defrost heat exchanger 66. For the frosted secondary evaporator 20, modulating valve 58 on any input secondary refrigerant line 60 connected thereto is closed. At the same time, secondary solenoid valve 70 disposed on defrost inlet secondary refrigerant line 68, which is connected to the input secondary refrigerant line 56 at a point thereon intermediate frosted secondary evaporator 20 and modulating valve 58, opens. As modulating valve 58 on input secondary refrigerant line 56 connected to frosted secondary evaporator 20 is closed, and circulation of secondary refrigerant to other secondary evaporators 20 connected to other input secondary refrigerant lines 56 is modulated by modulating valves 58 on the other input secondary refrigerant lines 56, a small defrost portion of secondary refrigerant in partially frozen state which would normally circulate to frosted secondary evaporator 20 during a refrigeration cycle circulates instead to defrost outlet secondary refrigerant line 72 connected to defrost heat exchanger 66.

The defrost portion circulates through defrost outlet secondary refrigerant line 72 to defrost heat exchanger 66, where it absorbs heat from the primary refrigerant vapors circulated therein. Thus, in defrost heat exchanger 66, defrost portion of secondary is heated from a partially frozen state into heated secondary refrigerant. Primary refrigerant vapor is cooled, possibly into primary refrigerant liquid, and is circulated, over heat exchange outlet line 76 and lines 148,150 to glycol-cooled condenser for continued use in the refrigeration cycle.

The heated defrost portion of secondary refrigerant is re-circulated from defrost heat exchanger over defrost re-circulating secondary refrigerant line 74 back to defrost inlet secondary refrigerant line 68 connected to input secondary refrigerant line 56 that is connected to frosted secondary evaporator 20. Since secondary solenoid valve 70 disposed on defrost inlet secondary refrigerant line 68 is open, heated secondary refrigerant circulates therethrough into input secondary refrigerant line 56 connected to frosted secondary evaporator 20. Since modulating valve 58 disposed on secondary refrigerant line 56 connected to frosted secondary evaporator 20 is closed, heated defrost portion of secondary refrigerant flows therein to frosted secondary evaporator-20, which is defrosted thereby. The heated secondary refrigerant of defrost portion is cooled in frosted secondary evaporator 20 and, after passing therethrough, circulates through output secondary refrigerant line 60 to secondary refrigerant tank 48. From secondary refrigerant tank 48, secondary refrigerant defrost portion is the circulated back to primary evaporator 10 for re-use in the same manner as for the refrigeration cycle.

When frosted secondary evaporator 20 is completely defrosted, defrost cycle for frosted secondary evaporator 20 terminates and secondary solenoid valve 70 on the related defrost inlet secondary refrigerant line 68 is closed and modulating valve 58 on the related input secondary refrigerating line is again at least partially open. Provided no other secondary evaporator 20 in engaged in defrost cycle, defrost solenoid valve 178 is also closed.

When a heat reclaim cycle is required or desirable, compressor 112*a* engages in the heat reclaim cycle. Compressor 112*b* continues to perform refrigeration cycle, including provision of primary refrigerant vapor as required for any secondary evaporators engaged in defrost cycle, as described above.

When the heat reclaim cycle is initiated, double set point pressure-regulating valve 154 disposed on conduit 152 is automatically set to a first setting for maintaining a first, higher pressure level in first discharge outlet manifold 140*a*, conduit 152, and first discharge outline line 138*a* for compressor 112*a* engaged in the heat reclaim cycle, compared to a second, lower pressure level in second discharge outlet manifold 140*b* for compressor 112*b*. The second pressure level is the level to which refrigerant liquid discharged from any compressor 112 engaged in the refrigeration cycle must be compressed. When compressor 112*a* is engaged in refrigeration cycle, it is to this second pressure level, corresponding to a second setting for double set point pressure-regulating valve 154, that double set point pressure-regulating valve 154 regulates pressure of primary refrigerant vapor.

As condensing of refrigerant vapor in refrigerant condenser is one of the principal uses for pressure generated by compressors 112 engaged in the refrigeration cycle, the second pressure level is substantially defined by, and varies with, the condensing pressure required. The second pressure level could be as low as 120 PSIG for R-22 in colder environments having sub 32° F. temperatures similar to those found in winter in Canada and the northern United States, since the ambient outdoor temperature will facilitate condensation of primary refrigerant vapor in the refrigerant condenser, thus reducing condensing pressure requirements for the refrigeration cycle. In contrast, primary refrigerant vapor from compressor 112*a* at first pressure level has a higher level of pressure corresponding to an evaporating temperature of +45° F. for the primary refrigerant, which increases the amount of primary latent heat storable and carriable by the primary refrigerant vapor at first pressure level. Specifically, in the embodiment, the first pressure level is attained by raising suction pressure in suction inlet line 136*a* of compressor 112*a* to a level corresponding to +45° F. evaporating temperature. However, as will be apparent to one skilled in the art, the first pressure level may be set to correspond to other evaporating temperatures, depending on system requirements.

Concurrently, with setting of double set pressure-regulating valve 154 to the first pressure level for the heat reclaim cycle, bypass passageway pressure-regulating valve 160 is engaged (e.g. opened) in bypass passageway, shown generally as 162, that is connected to first suction inlet line 136*a* of compressor 112*a*, and second discharge outlet manifold 140*b*. Thus, second discharge outlet line 138*b* of compressor 112*b*, engaged in the refrigeration cycle, is operatively connected to compressor 112*a* via first suction inlet line 136*a*. The bypass passageway pressure-regulating valve 160 causes primary refrigerant vapor at second pressure level from compressor 112*b* engaged in the refrigeration cycle to circulate from second discharge manifold 140*b* into first suction inlet line 136*a* of compressor 112*a* along bypass passageway 162. Thus, the primary refrigerant vapor, already compressed to high temperature and high pressure at the second pressure level, is circulated into bypass passageway 162 and compressed again by compressor 112*a* to reach the first pressure level. This re-circulating of the high temperature primary refrigerant vapor at second pressure level from second discharge manifold 140*b* into compressor 112*a* for further compression facilitates raising the pressure of primary refrigerant to first pressure level corresponding to the higher evaporation temperature of +45° F. To further facilitate compressing to first pressure level, a bypass passageway check valve 164 that is in in-series connection with bypass passageway pressure-regulating valve 160 closes to stop primary refrigerant vapor below the second pressure level from feeding into suction inlet line 136*a* of compressor 112*a*.

In order to maintain safe and stable suction temperature, primary refrigerant liquid from primary evaporator refrigerant liquid line 130 passes into suction manifold 134, via bypass passageway primary refrigerant liquid conduit 166, to a bypass passageway expansion valve 68 situated between primary evaporator refrigerant liquid line 130 and the first suction inlet line 136*a* for compressor 112*a*. The bypass passageway expansion valve 168 is a so-called desuperheating expansion valve and allows primary refrigerant liquid to mix with high-temperature, high-pressure primary refrigerant vapor. Thus, the temperature is stabilized and maintained at an acceptable level at first suction inlet line 136*a* for compressor 112*a* when engaged in the heat reclaim cycle.

Once compressed to first pressure level in heat reclaim cycle, primary refrigerant vapor is circulated to heat reclaim means, namely, in the embodiment, a liquid-cooled condenser 202 connected to liquid-to-air heat reclaim coils 208. Specifically, primary refrigerant vapor at first pressure level from compressor 112*a* is discharged through discharge outlet line 138*a* and discharge outlet manifold 140, through conduit 152, to heat reclaim inlet line 172 and then to indoor liquid-cooled condenser 202. Cool liquid contained in the liquid-cooled condenser 202 absorbs primary latent heat from the primary refrigerant vapor. The cool liquid is thus transformed into heated liquid. The heated liquid is then circulated through a closed loop system from the liquid-cooled condenser 202 into liquid heat reclaim inlet line 204, passing through liquid heat reclaim solenoid valves 206 disposed thereon, to liquid-to-air heat reclaim coils 208. The liquid-to-air heat reclaim coils 208 are exposed to cool air that is cooler than the heated liquid. The cool air causes the heated liquid to give off heat, i.e. the primary latent heat absorbed in the liquid-cooled condenser 202, which is absorbed by the liquid-to-air heat reclaim coils 208. The cool air in turn absorbs the primary latent heat from the liquid-to-air heat reclaim coils 208 and is heated thereby into heated air that may be circulated for comfort heating or other useful purposes. At the same time, as the heated liquid gives off the primary latent heat, absorbed by liquid-to-air heat reclaim coils 208, the liquid is again cooled into cool liquid. The cool liquid exits the liquid-to-air heat reclaim coils 208 through liquid heat reclaim outlet line 210 and is transferred to liquid pump 212 where the liquid is again pumped into the liquid-cooled condenser 202 for re-use and additional heat reclaim.

As the primary refrigerant vapor passes through the liquid-cooled condenser 202, the absorption of primary latent heat therefrom causes primary refrigerant to be at least partially converted, i.e. condensed, to primary refrigerant liquid, which exits liquid-cooled condenser 202 through refrigerant heat reclaim outlet line 174. Liquid-cooled condenser refrigerant pressure-regulating valve 214 disposed in refrigerant heat reclaim outlet line 174 maintains primary refrigerant, as condensed primary refrigerant liquid, within the liquid-cooled condenser 202 at adequate pressure to ensure that the primary refrigerant carries enough primary latent heat to heat the liquid to the desired liquid temperature for subsequent absorption of the primary latent heat from the liquid in the liquid-to-air heat reclaim coils 208 to provide comfort heating or to fulfill another useful purpose. The liquid used in liquid-cooled condenser 202 and in liquid-to-air heat reclaim coils 208 may be, among others, water or glycol. Thus, liquid-cooled condenser 202 may be, to mention two possibilities, another glycol-cooled condenser or a water-cooled condenser. Similarly, liquid-to-air heat reclaim coils 208 may be, for example, water-to-air heat reclaim coils or glycol-to-air heat reclaim coils.

Once the primary refrigerant circulates through refrigerant heat reclaim outlet line 174, it circulates therefrom through lines 48, 50 to refrigerant condenser, namely the glycol-cooled condenser 222 and air-cooled glycol cooler 224. Thus, the refrigerant condenser, i.e. condenser 222 and air-cooled glycol cooler 224, are operatively connected to the heat reclaim means, namely liquid-cooled condenser 202 connected to liquid-to-air heat reclaim coils 208. The primary refrigerant liquid then passes to primary evaporator 10, and then to the suction manifold 34, as described previously for the refrigeration cycle.

During the heat reclaim cycle, the increased pressure, corresponding to an evaporating temperature of +45° F., of the primary refrigerant vapor at the first pressure level elevates the amount of primary latent heat that may be carried and stored by the primary refrigerant vapor. This additional primary latent heat, at least compared to primary refrigerant vapor at second pressure level, can be reclaimed during the heat reclaim cycle, thus increasing heat reclaimed and efficiency. At the same time, the further compressing of the primary refrigerant vapor at the second pressure level to reach the first pressure level ensures that at least a primary latent heat portion of the primary latent heat in the primary refrigerant from compressor 112*b*, in addition to that from compressor 112*a*, is also reclaimed. This primary latent heat portion can vary from a minimal or nil amount of the primary latent heat for environments having very warm ambient air temperatures to the totality of the primary latent heat in colder environments. The relatively lower temperature heat of compressor 112*b*, operating at comparatively lower second pressure level and used for refrigeration, is thus transformed very efficiently by compressor 112*a* during the heat reclaim cycle into high-temperature value heat usable for comfort heating. Further, the lower second pressure level to which compressor 112*b* compresses primary refrigerant allows compressors 112 to complete refrigeration cycles more efficiently, especially in colder environments. In addition, the flow of primary refrigerant liquid to the glycol-cooled condenser 114 from the liquid-cooled condenser 202, i.e. after circulating through heat reclaim means, provides an amount of primary refrigerant liquid, already condensed, to the refrigerant condenser 222. The amount of primary refrigerant vapor that must be condensed therein is therefor reduced, thus further reducing the condensing pressure required for, and energy consumed by, compressor 112 engaged in the refrigeration cycle. Therefore, the use of the bypass passageway 162 to circulate primary refrigerant vapor compressed in compressor 112*b* for further compression in compressor 112*a*, in combination with maintenance of higher pressure and increased evaporating temperature for primary refrigerant vapor at the first pressure level compressed in compressor 112*a*, provides greater heat reclaim in heat reclaim means while still allowing for lower pressure of refrigerant vapor discharged by compressor 112*b*, and less energy use thereby, engaged in the refrigeration cycle.

As one skilled in the art will realize, other types of refrigerant condenser and heat reclaim means may be used, such as refrigerant-to-air heat reclaim coils, air-cooled refrigerant condensers, or the like. For further information, reference may be had, for example, to the inventors' co-pending U.S. patent application Ser. No. 11/103,523 for a heat reclaim refrigeration system and method, filed on Apr. 12, 2005. It is not the intention of the inventor to limit the scope of the invention to those condensers and heat reclaim coils described specifically herein.

Similarly, it is not the intention of the inventor to limit the scope of the invention to the specific configurations of components described herein. For example, a different number of compressors 112*a*, 112*b* could be used. Further, it will be apparent to one skilled in the art that heat reclaimed may be used for purposes other than for comfort heating, such as, for example, heating water. In addition, while the embodiments described herein are appropriate for grocery-store refrigeration, it is by no means the intention of the inventor to so limit the application of the invention.

Finally, it will be apparent to one skilled in the art that other embodiments of the present invention may be envisaged. The description provided herein is provided for purposes of illustration and not limitation. While a specific embodiment has been described, those skilled in the art will recognize many alterations that could be made within the spirit of the invention, which is defined solely according to the following claims.

We claim:

1. A dual refrigerant refrigeration system comprising:

at least one compressor for compressing a primary refrigerant, as a primary refrigerant vapor, said compressor being engageable in a refrigeration cycle;

a refrigerant condenser operatively connected to said at least one compressor for condensing, after said compressing, said primary refrigerant vapor into a primary refrigerant liquid;

a spray primary evaporator operatively connected to said at least one compressor and having at least one secondary refrigerant tube through which a secondary refrigerant circulates in said primary evaporator and at least one perforated tube operatively connected to said refrigerant condenser and through which said primary refrigerant liquid flows, said primary refrigerant liquid being sprayed through perforations in said perforated tube onto said at least one secondary refrigerant tube and absorbing thereby a secondary latent heat of said secondary refrigerant and cooling said secondary refrigerant therein to a partially frozen state in which a fusion portion thereof is frozen, said secondary latent heat comprising a latent heat of fusion absorbed during freezing of said fusion portion and said primary refrigerant liquid refrigerant being evaporated into said primary refrigerant vapor by absorbing said secondary latent heat; and at least one secondary evaporator operatively connected to said primary evaporator and engageable in said refrigeration cycle for receiving said partially frozen secondary refrigerant for at least partial thawing of said partially frozen secondary refrigerant, including said fusion portion thereof, into a partially thawed state by at least partial re-absorption of said secondary latent heat, and thereby of said latent heat of fusion, from material refrigerated by said secondary evaporator, said fusion portion increasing said secondary latent heat re-absorbed from said material by said secondary refrigerant during said refrigeration cycle.

2. The system of claim 1, further comprising a defrost heat exchanger operatively connected to said at least one compressor and said at least one secondary evaporator, said defrost heat exchanger and said at least one secondary evaporator being engageable when said secondary evaporator accumulates frost, thereby becoming a frosted secondary evaporator, in a defrost cycle in which said primary refrigerant vapor compressed and heated by said compressor and said secondary refrigerant are circulated in said defrost heat exchanger for heating said secondary refrigerant therein with said primary refrigerant vapor and said secondary refrigerant is circulated subsequent to said heating to said frosted secondary evaporator for melting said frost and defrosting said frosted secondary evaporator.

3. The system of claim 1, further comprising a secondary refrigerant tank operatively connected to said primary evaporator and to said at least one secondary evaporator for storing said secondary refrigerant, said secondary refrigerant being circulated to said secondary refrigerant tank from said primary evaporator after being cooled therein into said partially frozen state and being circulated from said secondary refrigerant tank to said at least one secondary evaporator during said refrigeration cycle for said at least partial thawing.

4. The system of claim 1, further comprising a secondary refrigerant pump operatively connected to said primary evaporator and to said secondary evaporator by at least one secondary refrigerant line, said secondary refrigerant pump pumping said secondary refrigerant through said at least one secondary refrigerant line for circulating said secondary refrigerant in said partially frozen state therethrough from said primary evaporator to said at least one secondary evaporator.

5. The system of claim 1, further comprising a re-circulating pump operatively connected to said at least one refrigerant condenser and said primary evaporator, said re-circulating pump receiving said primary refrigerant liquid from said condenser and pumping said primary refrigerant liquid into said primary evaporator for circulation and evaporation therein into said primary refrigerant vapor.

6. The system of claim 2, further comprising a secondary refrigerant tank operatively connected to said primary evaporator and to said at least one secondary evaporator for storing said secondary refrigerant, said secondary refrigerant being circulated to said secondary refrigerant tank when said at least one secondary evaporator is said frosted said secondary evaporator after being re-circulated thereto for said defrost cycle, said secondary refrigerant being subsequently circulated from said secondary refrigerant tank to said primary evaporator for cooling therein into said partially frozen state.

7. The system of claim 2, further comprising at least one input secondary refrigerant line, having a modulating valve disposed thereupon, for operatively connecting said at least one secondary evaporator to said primary evaporator and through which a portion of said secondary refrigerant may circulate to said at least one secondary evaporator, said portion being modulated by said modulating valve.

8. The system of claim 2, further comprising a primary defrost outlet line, operatively connecting said at least one compressor to said heat exchanger and through which said primary refrigerant vapor is circulated to said defrost heat exchanger after being compressed by said at least one compressor.

9. The system of claim 2, further comprising a primary defrost outlet line, operatively connecting said at least one compressor to said heat exchanger and through which said primary refrigerant vapor is circulated to said defrost heat exchanger after being compressed by said at least one compressor.

10. The system of claim 3, wherein said secondary refrigerant is further circulated from said at least one secondary evaporator after said at least partial thawing to said secondary refrigerant tank and circulated thereafter from said secondary refrigerant tank to said primary evaporator for cooling therein into said partially frozen state.

11. The system of claim 3, further comprising a tank secondary refrigerant pump operatively to said secondary refrigerant tank and to said secondary evaporator by at least one secondary refrigerant line, said tank secondary refrigerant pump pumping said secondary refrigerant through said at least one secondary refrigerant line for circulating said secondary refrigerant in said partially frozen state therethrough from said secondary refrigerant tank to said at least one secondary evaporator.

12. The system of claim 7, wherein said modulating valve is at least partially opened for allowing said portion to flow therethrough to said secondary evaporator when said at least one secondary evaporator is engaged in said refrigeration cycle.

13. The system of claim 7, further comprising:

a defrost outlet secondary refrigerant line operatively connected to said defrost heat exchanger and to each said input secondary refrigerant line; and for each said input secondary refrigerant line, a respective defrost inlet secondary refrigerant line operatively connected thereto, at a position between said modulating valve and said at least one secondary evaporator, and to said heat exchanger, wherein, during said defrost cycle, said modulating valve on said input secondary refrigerant line operatively connected to said frosted secondary evaporator is closed for causing said portion therefor to circulate through said defrost outlet secondary refrigerant line to said defrost heat exchanger for heating therein, said portion being circulated from said defrost heat exchanger after heating therein to said respective defrost inlet secondary refrigerant line operatively connected to said input secondary refrigerant line operatively connected to said frosted secondary evaporator for defrosting thereof.

14. The system of claim 13, further comprising, for each said respective defrost inlet secondary refrigerant line, a respective secondary solenoid valve disposed thereupon, said respective secondary solenoid valve being opened when said secondary evaporator operatively connected by said input secondary refrigerant is engaged, as said frosted secondary evaporator, in said defrost cycle to allow said portion to circulate through said input secondary refrigerant line after heating thereof in said defrost heat exchanger to said frosted secondary evaporator.

15. The system of claim 13, further comprising a defrost solenoid valve disposed upon said primary defrost outlet line, said defrost solenoid valve being opened during said defrost cycle to enable circulation of said primary refrigerant vapor through said defrost primary outlet line to said defrost heat exchanger, said defrost solenoid valve being otherwise closed.

16. The system of claim 13, further comprising a primary heat exchange outlet line, operatively connecting said defrost heat exchanger to said refrigerant condenser and through which said primary refrigerant vapor is circulated from said defrost heat exchanger to said refrigerant condenser for condensing therein after said primary refrigerant vapor has circulated from said at least one compressor to said defrost heat exchanger for heating said secondary refrigerant during said defrost cycle.

17. The system of claim 1, wherein said at least one compressor comprises:

a first compressor engageable in a heat reclaim cycle, for, during said heat reclaim cycle, compressing said primary refrigerant vapor to a first pressure level, said primary refrigerant vapor being discharged from said first compressor through a first discharge outlet line operatively connected thereto and to said refrigerant condenser;

a second compressor engageable in said refrigeration cycle for compressing said primary refrigerant vapor to a second pressure level, said primary refrigerant vapor being discharged from said second compressor through a second discharge outlet line operatively connected thereto and to said refrigerant condenser; and a heat reclaim means having at least one heat reclaim inlet line operatively connected to said first discharge outlet line for absorbing primary latent heat from said primary refrigerant vapor discharged therein during said heat reclaim cycle, thereby reclaiming said primary latent heat, wherein said first pressure level is greater than said second pressure level, said primary refrigerant vapor at said first pressure level having an increased evaporating temperature for increasing said primary latent heat reclaimable therefrom by said heat reclaim means.

18. The system of claim 17, wherein said first compressor is further engageable in said refrigeration cycle and, when engaged in the refrigeration cycle, compresses said primary refrigerant vapor to said second pressure level, said primary refrigerant vapor being discharged from said first compressor through said first discharge outlet line to said refrigerant condenser for condensing into said primary refrigerant liquid.

19. The system of claim 17, wherein said heat reclaim means comprises:

at least one indoor liquid-cooled condenser, connected to said heat reclaim inlet line, containing cool liquid for condensing said primary refrigerant vapor into said primary refrigerant liquid and thereby releasing said latent heat for absorption by said cool liquid for heating said cool liquid into heated liquid; and at least one liquid-to-air heat reclaim coil operatively connected to said indoor liquid-cooled condenser, said liquid-to-air heat reclaim coil being exposed to cool air which causes said heated liquid to release said latent heat which is absorbed by said cool air through said liquid-to-air heat reclaim coil, thereby cooling said heated liquid into said cool liquid and heating said cool air into heated air, thereby reclaiming said primary latent heat.

20. The system of claim 17, wherein said refrigerant condenser comprises an indoor glycol-cooled condenser, operatively connected to said first and to said second compressors, and an outdoor air-cooled glycol cooler, operatively connected to said indoor glycol-cooled condenser, said indoor glycol-cooled condenser circulating cooled glycol therein from said outdoor air-cooled glycol cooler for said condensing of said primary refrigerant vapor at said second pressure level into said primary refrigerant liquid, said cooled glycol being thereby heated into heated glycol and re-circulated to outdoor air-cooled glycol cooler for cooling said heated glycol with cool air into said cooled glycol.

21. The system of claim 19, wherein said indoor liquid-cooled condenser is a glycol-cooled condenser and said liquid-to-air heat reclaim coil is a glycol-to-air heat reclaim coil, said cool liquid and said heated liquid being glycol.

22. The system of claim 19, wherein said liquid-cooled condenser is a water-cooled condenser and said liquid-to-air heat reclaim coil is a water-to-air heat reclaim coil, said cool liquid and said heated liquid being water.

* * * * *